US012274352B2

(12) United States Patent
Kretsinger

(10) Patent No.: US 12,274,352 B2
(45) Date of Patent: Apr. 15, 2025

(54) MOLLE/PALS MOUNTING PLATFORM ASSEMBLY

(71) Applicant: TRG Media and Innovations Corp, Burnsville, MN (US)

(72) Inventor: Shane Allan Kretsinger, Grantsburg, WI (US)

(73) Assignee: TRG Media and Innovations Corp, Burnsville, MN (US)

( * ) Notice: Subject to any disclaimer, the term of this patent is extended or adjusted under 35 U.S.C. 154(b) by 394 days.

(21) Appl. No.: 17/993,325

(22) Filed: Nov. 23, 2022

(65) Prior Publication Data

US 2024/0049870 A1 Feb. 15, 2024

Related U.S. Application Data

(60) Provisional application No. 63/397,345, filed on Aug. 11, 2022.

(51) Int. Cl.
*A45F 5/02* (2006.01)

(52) U.S. Cl.
CPC ..... *A45F 5/02* (2013.01)

(58) Field of Classification Search
CPC ..... A45F 5/02; F41C 33/041
USPC ..... 24/3.1; 224/665, 666, 667, 672, 674
See application file for complete search history.

(56) References Cited

U.S. PATENT DOCUMENTS

| | | | | | |
|---|---|---|---|---|---|
| 573,685 | A * | 12/1896 | Munro | A41F 11/02 | 292/251 |
| 2,931,085 | A * | 4/1960 | Benlian | A41F 9/007 | 24/528 |
| 5,685,732 | A * | 11/1997 | Lane | H01R 13/6392 | 24/523 |
| 7,380,692 | B2 * | 6/2008 | Kostal | A45F 5/02 | 224/269 |
| 7,805,875 | B1 * | 10/2010 | Obong | F41A 9/61 | 224/931 |
| 8,297,562 | B1 * | 10/2012 | Yeates | A45F 5/02 | 248/222.51 |
| 8,544,706 | B2 * | 10/2013 | Crye | F41C 33/0236 | 224/198 |
| D788,254 | S * | 5/2017 | Baehler | D8/356 | |
| D839,716 | S * | 2/2019 | Gertsma | D8/356 | |
| D902,698 | S * | 11/2020 | Walterscheid | D8/356 | |
| D950,946 | S * | 5/2022 | Smith | D3/222 | |
| 11,530,897 | B2 * | 12/2022 | Smith | A45F 5/02 | |
| 11,944,184 | B2 * | 4/2024 | Stanton | A45F 3/00 | |
| 11,986,083 | B2 * | 5/2024 | Stutz | A44B 99/00 | |
| 12,130,115 | B2 * | 10/2024 | Smith | A45F 5/02 | |
| 2004/0051015 | A1 * | 3/2004 | Ohrling | A47B 96/065 | 248/214 |
| 2010/0001155 | A1 * | 1/2010 | Grundy | A45F 5/02 | 248/231.81 |

(Continued)

*Primary Examiner* — Justin M Larson
(74) *Attorney, Agent, or Firm* — Westman, Champlin & Koehler, P.A.

(57) ABSTRACT

A mounting device comprising two or more plates, the device configured for insertion into one or more rows of MOLLE PALS strapping and/or mounted to a surface with one or more fasteners, the device comprising a captured mounting platform comprising both downward facing and upward facing arms with a joining interface therebetween such that the device provides a fixed surface for removably attaching equipment or gear thereto.

14 Claims, 2 Drawing Sheets

(56) References Cited

U.S. PATENT DOCUMENTS

| | | | | |
|---|---|---|---|---|
| 2011/0036880 | A1* | 2/2011 | Lee | A45F 5/02 224/269 |
| 2012/0174341 | A1* | 7/2012 | Rogers | F41C 33/041 24/3.1 |
| 2012/0175390 | A1* | 7/2012 | Rogers | F41C 33/045 29/453 |
| 2012/0175391 | A1* | 7/2012 | Rogers | F41C 33/045 224/191 |
| 2016/0143425 | A1* | 5/2016 | Tvrdy | A45F 5/02 24/3.12 |
| 2022/0061506 | A1* | 3/2022 | Woodward | A45F 3/14 |
| 2024/0049870 | A1* | 2/2024 | Kretsinger | A45F 5/02 |

* cited by examiner

MOLLE/PALS MOUNTING PLATFORM ASSEMBLY

CROSS REFERENCE TO RELATED APPLICATION

This application claims priority to and the benefit of U.S. provisional patent application Ser. No. 63/397,345, filed on Aug. 11, 2022, the contents of which are incorporated herein in their entirety.

BACKGROUND

The MOLLE equipment carrying system was invented in 1997 and first saw use after 2001. "MOLLE" stands for "modular light-weight load-carrying equipment" and consists of multiple rows of fabric straps known as PALS ("pouch attachment ladder system"), often found on backpacks, vests and other military, law enforcement and even civilian outdoor and tactical gear.

Gear mounted on MOLLE systems historically consists of items that are generally lightweight and relatively small in size, and the use of simple lightweight devices which are often made of plastic to interface the gear with the MOLLE strapping is available in many shapes and sizes.

Typically, items mounted on MOLLE systems utilize a mounting body that has two or more downward facing arms that insert into the PALS straps or clips onto the individual cells of PALS straps creating a semi rigid attachment that is generally satisfactory for lightweight gear mounting.

In some instances, the downward facing arms are fastened with a cover strap causing the mounting devices to be less prone to unwanted upward movement which occasionally causes gear to become accidentally detached, other devices lack the additional locking feature.

Plastic, resin, or other forms of composite materials are by far the most common materials that these mounting devices are made of.

SUMMARY

The present disclosure relates to equipment attachment and methods for transport that implements the use of a multi-piece mounting system which allows for a physically locking mounting platform, with both downward and upward facing arms joined at a midpoint, to be locked in place between two or more rows of MOLLE PALS webbing.

In one or more embodiments, the two pieces of the system are identical in construction and capable of being assembled together by rotating and inverting one of the pieces with respect to the other, causing the fastening geometry of each piece to align. The attachment is a secure but removable attachment that can be furthered with mechanical fasteners.

The system is designed to utilize one or more rows of the MOLLE PALS webbing on an article or garment to create a rigid or semi-rigid method of attachment of equipment thereto.

In one or more embodiments, the system features threaded and/or non-threaded apertures in strategic locations which allow for the mounting of accessories to the system, or for mounting the system to other substrates such as a wall, dash of an automobile or other suitable surface with mechanical fasteners.

Another aspect of the present disclosure relates to a mounting device comprising two or more plates, the device configured for insertion into one or more rows of MOLLE PALS strapping and the device comprising a captured mounting platform comprising both downward facing and upward facing arms with a joining interface therebetween such that the device provides a fixed surface for removably attaching equipment or gear.

The mounting device is comprised of metals, alloys, resins, carbon fiber, or plastic composites.

In one or more embodiments, the arms are situated in opposing upward and downward facing directions allowing the device to be captured between two or more rows of the MOLLE PALS fabric ladder.

In one or more embodiments, the arms are situated in opposing upward and downward facing directions allowing the device to be captured on a single row of the MOLLE PALS fabric ladder.

The two or more plates are joined by screws, rivets, adhesives, or combinations thereof.

The device provides a generic mounting platform without holes for mounting or attaching gear.

The device provides a pre-arranged configuration of holes for mounting accessories or gear to the device.

The two or more plates are substantially identical in construction and configured for coupling together by inverting and reversing a first plate with respect to a second plate and aligning attachment geometry for coupling the plates together.

Yet another aspect of the present disclosure relates to a mounting assembly comprising a plurality of plates, each plate comprising a main body; a pair of locking arms extending from the main body; one or more apertures in the main body, and one or more protrusions on a first face of the main body, wherein two plates are joined together by connecting one or more apertures in the main body of a first plate of the plurality of plates with one or more protrusions in the main body of a second plate in the plurality of plates.

Each plate further comprises a center aperture in the main body wherein the center aperture receives securing hardware to further secure two plates together or to secure the assembly to a surface with a fastener.

Each plate further comprises a center aperture in the main body wherein the center apertures receives securing hardware for attaching equipment to the assembly.

The one or more protrusions on the first face of the main body of each plate have an aperture centered therein. When the two plates are joined together there are then one or more apertures in the main body and the one or more apertures are configured to receive a fastener therein for further securing the two plates joined together.

Each plate has a back side that is substantially flat and a front side having a ledge such that a thickness of the plate at the locking arms is greater than a thickness of the plate at the main body.

The two plates are joined together at the main bodies with the locking arms of the first plate extending in a first direction from the joined main bodies and the locking arms of the second plate extending in a second direction from the joined main bodies wherein the first and second directions are opposing directions.

DETAILED DESCRIPTION

A mounting system according to the present disclosure comprises two or more bodies which are capable of being joined by mechanical fasteners and/or coupled via integral geometries of the two bodies, to create a mounting assembly. The mounting assembly can be used to connect or couple to a first element and hold a second element thereto. Thus, the mounting assembly can be used to mount various items. The mounting system comprises both upwardly and downwardly facing arms configured to capture the mounting system in, on, or between, for example, rows of pre-existing MOLLE PALS strapping found on various items such as vests, backpacks, and other gear. The system can be used with various strapping systems similar to the MOLLE PALS system and this strapping system may be mounted and/or secured to any number of accessories, equipment or surfaces.

The mounting assembly described herein provides a rigid or semi-rigid mounting surface on which other gear can be affixed thereto through the use of a wide variety of mechanical fasteners.

In one or more embodiments, the mounting assembly comprises various apertures in the plates for various and multiple uses. The apertures may be threaded and/or non-threaded apertures provided in strategic locations on each plate and which allow for the mounting of accessories to the assembly, and/or for mounting the assembly to other substrates such as a wall, dash of an automobile, or other suitable surface with mechanical fasteners.

In one non limiting example embodiment, the mounting assembly described herein provides a mechanism for supporting heavier equipment and gear in conjunction with or on the equipment vests, ballistic vests, and various or similar items equipped with MOLLE/PALS strapping.

Figure 2:
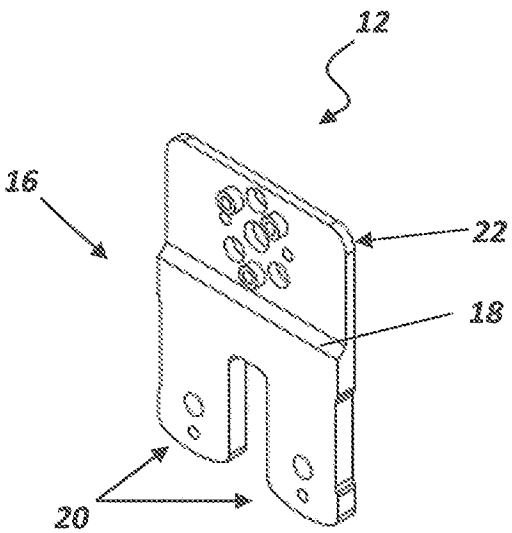
FIG. 2 is a top, front perspective view of a plate of the mounting assembly.
Figure 1:
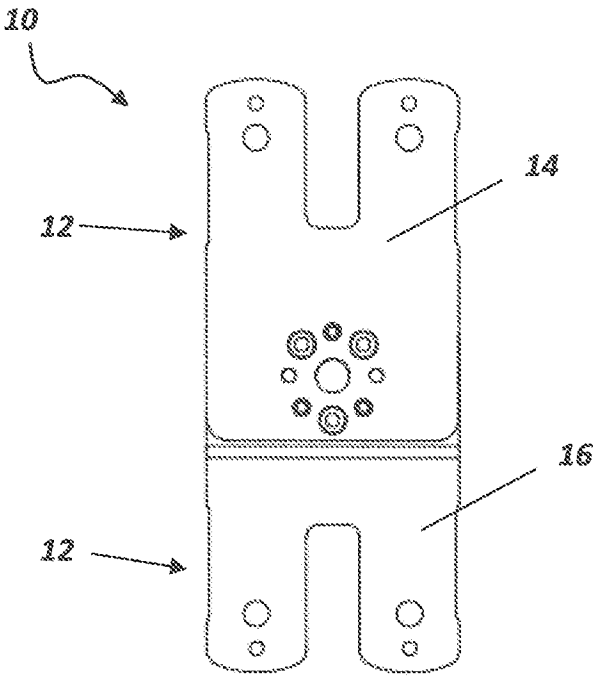
FIG. 1 is perspective view of a mounting assembly.
Figure 5:
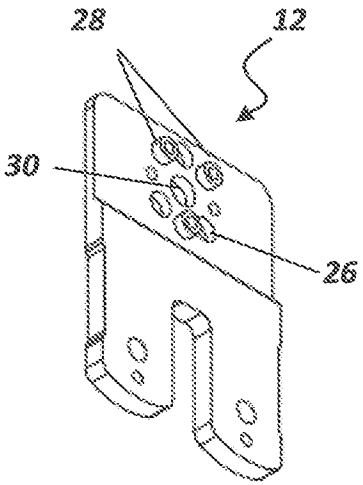
FIG. 5 is bottom, front perspective view of the plate.
Figure 4:
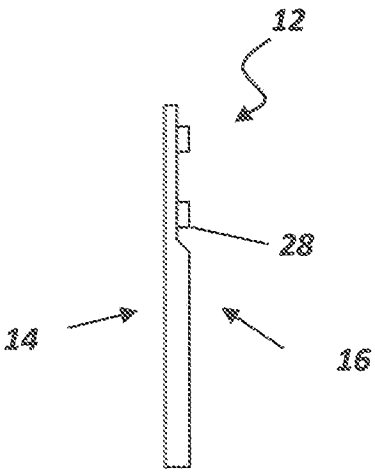
FIG. 4 is a side view of the plate.
Figure 3:
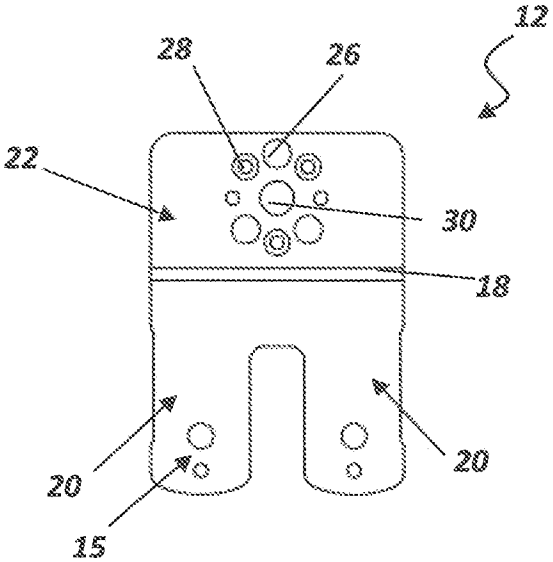
FIG. 3 is a front view of the plate.

One embodiment of the mounting assembly is illustrated in the figures. As shown in FIG. 1, the attachment or coupling of two rigid or semi rigid mounting plates 12 forms the mounting assembly 10. The assembly 10 comprises two or more plates 12 of the same or similar construction and when secured together in opposing directions results in an assembly 10 having locking arms 20 facing in opposing directions. The assembly 10 has increased strength and load support when compared to prior art systems and the assembly 10 construction prevents accidental detachment of the assembly from the MOLLE/PALS strapping.

Referring to FIGS. 2-5, the assembly 10 comprises two or more individual plates 12. Each plate 12 may have a back side 14 that is substantially flat and a front side 16 which may have a lip of ledge 18 which connects a pair of locking arms 20 to the main body 22 of the plate 12. The lip or ledge 18 aids in connection of two plates 12 together. A shown in FIG. 1, the front face 16 of the main body 22 of each plate 12 are contacted and connected to form the assembly 10 while the plates are in opposing orientations such that the arms 20 of a first plate 12 extend on one side of the assembly 10 and the arms 20 of a second plate 12 extend on an opposing side of the assembly 10. Each arm 20 may also be provided with one or more apertures 15 for additional usage in mounting equipment to the assembly 10.

Referring to FIGS. 2-5, in one embodiment, a thickness of the plate 12 at the arms 20 is greater than a thickness of the plate at the main body 22 such that when two plates 12 are connected via connection of the respective main bodies 22 the thickness of the assembly 12 at the main body 12 is substantially the same as the thickness of the assembly 12 and the respective opposing locking arms 20. Each plate 12 has a body 22 integrally connected to a pair of locking arms 20. The arms 20 have a space therebetween which the allows the arms to be inserted behind straps or the like, for example, behind straps of a MOLLE PALS system for use.

Each main body 22 further comprises fastening geometry configured to allow two plates 12 to be connected to one other in the orientation shown in FIG. 1. For example, each main body 22 comprises one or more apertures 26 and one or more protrusions 28. The one or more protrusions 28 may further have apertures therein or otherwise surround an aperture. The apertures 26 and protrusions 28 are spaced and positioned on the front side 22 in a manner that allows one or more apertures 28 to receive a corresponding one of the one or more protrusions 28 therein when securing two plates 12 together. The protrusions 28 may be internally threaded protrusions 28. This allows the protrusions 28 to accept a threaded fastener. If not threaded, the protrusions 28 may also accept a non-threaded fastener.

The apertures 26 and protrusions 28 may have a geometry and dimensions that allow the protrusions 28 to connect and/or couple to the apertures 26 via a friction fit, snap fit, or the like and in a secure manner. An additional mounting aperture 30 which may be centered in the main body 22 may also be provided and configured to optionally receive an external or additional fastener therethrough. This mounting aperture 30 may be a threaded aperture and the fastener may be a threaded fastener such as a screw for securing the plates 12 together. When two plates 12 are coupled together the mounting apertures 30 may be aligned and fastening hardware can be inserted therein and/or therethrough to secure the assembly 10.

One or more of the additional apertures 15 and/or mounting aperture 30 are optional apertures for mounting gear. One or both plates 12 may be provided in a clean configuration for customization where no pre-spaced apertures are provided outside of the fastening geometry. This allows a user to customize the plates 12 with apertures required for mounting specific gear. Alternatively, an aperture pattern is provided on one or both plates per a known hole pattern requirement for specific equipment attachment.

The plate 12 may be comprised of a metals, alloy, resin, carbon fiber, plastic, composites metal, plastic, or like material having high strength, durability and lightweight characteristics. Materials such as aluminum, titanium, hard plastics and combinations thereof may also be used.

The assembly 10 can be secured to MOLLE/PALS strapping by way of either or both locking arms 20.

The two plates 12 are mechanically affixed in a removable fashion and then may provide either a generic or pre-arranged mounting platform on which to mount gear which can then be heavier or more prone to unwanted discharge with other mounting accessories on the market. Although the present disclosure has been described with reference to preferred embodiments, workers skilled in the art will recognize that changes may be made in form and detail without departing from the spirit and scope of the disclosure.

The invention claimed is:

1. A mounting device comprising two or more plates, the device configured for insertion into one or more rows of MOLLE PALS strapping and the device comprising a captured mounting platform comprising both downward facing arms of one plate and upward facing arms of another plate with a joining interface therebetween such that the device provides a fixed surface for removably attaching equipment or gear.

2. The device of claim 1, wherein the mounting device is comprised of metals, alloys, resins, carbon fiber, or plastic composites.

3. The device of claim 1, wherein the arms are situated in opposing upward and downward facing directions allowing the device to be captured between two or more rows of the MOLLE PALS fabric ladder.

4. The device of claim 1, wherein the arms are situated in opposing upward and downward facing directions allowing the device to be captured on a single row of the MOLLE PALS fabric ladder.

5. The device of claim 1, wherein the two or more plates are further joined by screws, rivets, adhesives, or combinations thereof.

6. The device of claim 1, wherein the device provides a generic mounting platform without holes for attaching gear or accessories thereto.

7. The device of claim 1, wherein the device provides a pre-arranged configuration of holes for mounting accessories or gear to the device.

8. The device of claim 1 wherein the two or more plates are substantially identical in construction and configured for coupling together by inverting and reversing a first plate with respect to a second plate and aligning attachment geometry for coupling the plates together.

9. A mounting assembly comprising:

a plurality of plates, each plate comprising:

a main body;

a pair of locking arms extending from the main body;

one or more apertures in the main body, and one or more protrusions on a first face of the main body, wherein two plates are joined together by connecting one or more apertures in the main body of a first plate of the plurality of plates with one or more protrusions in the main body of a second plate in the plurality of plates.

10. The mounting assembly of claim 9 wherein each plate further comprises a center aperture in the main body.

11. The mounting assembly of claim 9 wherein the one or more protrusions on the first face of the main body have an aperture centered therein.

12. The mounting assembly of claim 11 wherein when the two plates are joined together there are one or more apertures in the main body and the one or more apertures are configured to receive a fastener therein for further securing the two plates joined together.

13. The mounting assembly of claim 9 wherein each plate has a back side that is substantially flat and a front side having a ledge such that a thickness of the plate at the locking arms is greater than a thickness of the plate at the main body.

14. The mounting assembly of claim 9 wherein the two plates are joined together at the main bodies with the locking arms of the first plate extending in a first direction from the joined main bodies and the locking arms of the second plate extending in a second direction from the joined main bodies wherein the first and second directions are opposing directions.

* * * * *